US008708015B2

(12) United States Patent
Kobayashi

(10) Patent No.: US 8,708,015 B2
(45) Date of Patent: Apr. 29, 2014

(54) LABEL MANUFACTURING DEVICE AND LABEL PRINTER

(75) Inventor: Kenji Kobayashi, Tokyo (JP)

(73) Assignee: Lintec Corporation, Tokyo (JP)

( * ) Notice: Subject to any disclaimer, the term of this patent is extended or adjusted under 35 U.S.C. 154(b) by 0 days.

(21) Appl. No.: 13/580,040

(22) PCT Filed: Feb. 10, 2011

(86) PCT No.: PCT/JP2011/052821

§ 371 (c)(1),
(2), (4) Date: Aug. 20, 2012

(87) PCT Pub. No.: WO2011/102283

PCT Pub. Date: Aug. 25, 2011

(65) Prior Publication Data

US 2012/0318459 A1 Dec. 20, 2012

(30) Foreign Application Priority Data

Feb. 22, 2010 (JP) ..... 2010-035941

(51) Int. Cl.
*B65C 9/46* (2006.01)
*B65H 37/00* (2006.01)

(52) U.S. Cl.
USPC ..... 156/387; 156/540

(58) Field of Classification Search
USPC ..... 156/230, 234, 247, 249, 289, 384–387, 156/537, 538, 540
See application file for complete search history.

(56) References Cited

U.S. PATENT DOCUMENTS

| | | | | |
|---|---|---|---|---|
| 5,707,475 | A * | 1/1998 | Steidinger et al. | 156/257 |
| 8,025,451 | B2 * | 9/2011 | Yamaguchi et al. | 400/613 |
| 8,211,826 | B2 * | 7/2012 | Keeton et al. | 503/226 |
| 8,258,240 | B2 * | 9/2012 | Suzuki et al. | 525/228 |

FOREIGN PATENT DOCUMENTS

| | | |
|---|---|---|
| JP | B2-7-35104 | 4/1995 |
| JP | A-7-227924 | 8/1995 |
| JP | A-10-6564 | 1/1998 |
| JP | A-2002-1845 | 1/2002 |
| JP | A-2004-262058 | 9/2004 |

OTHER PUBLICATIONS

Sep. 18, 2012 International Preliminary Report on Patentability issued in International Application No. PCT/JP2011/052821.
Jun. 7, 2011 International Search Report issued in International Application No. PCT/JP2011/052821 (with translation).

* cited by examiner

*Primary Examiner* — Sing P Chan
(74) *Attorney, Agent, or Firm* — Oliff PLC

(57) ABSTRACT

A base material sheet is fed from a base material supplying unit by a feeding drive unit. A raw film made up of an adhesive film temporarily attached with a first and release liner and a second release liner is supplied from an adhesive film supplying unit and the second release liner is peeled off from the adhesive film by a peeling unit. A label printer prints on the base material sheet and attaches the adhesive film onto the base material sheet. A label sheet that includes the base material sheet, the adhesive film and the first release liner is supplied to a cutter. After a cut line corresponding to a shape of a label is provided on the base material sheet by the cutter, the base material sheet is further transferred by a guide roller and is wound up by a product winding unit.

5 Claims, 3 Drawing Sheets

LABEL MANUFACTURING DEVICE AND LABEL PRINTER

TECHNICAL FIELD

Figure 1:
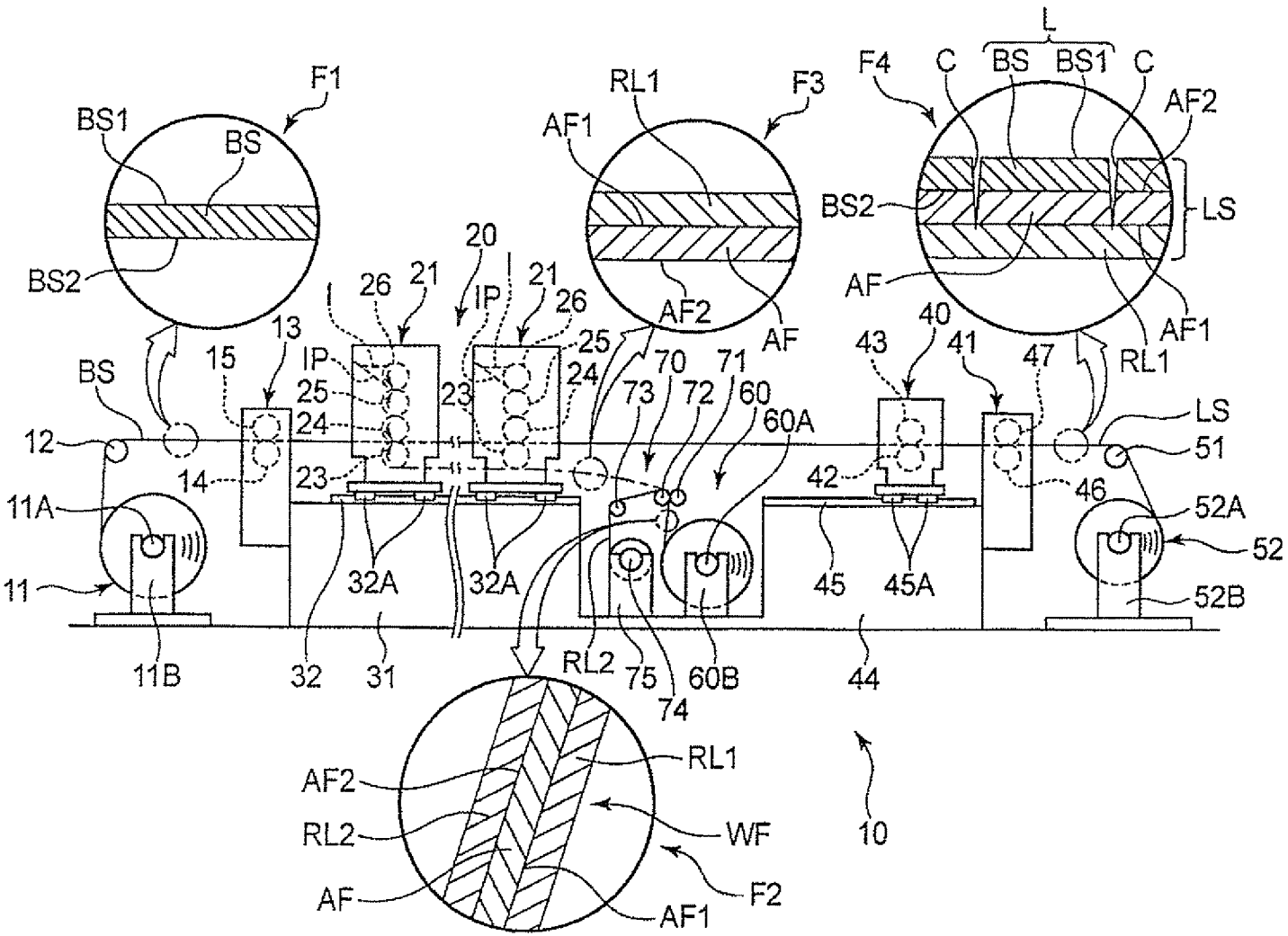

The present invention relates to a label manufacturing device to produce label sheets with a triple layered structure having a base material sheet on which printing is made, an adhesive agent layer and a release liner, as well as a label printer to print on the label sheets with the triple layered structure of the base material sheet, the adhesive agent layer and the release liner.

BACKGROUND ART

Conventionally, a device to print on a base material sheet on which an adhesive agent layer is provided in advance (e.g., Patent Literature 1) and a device to apply an adhesive agent onto a printed base material sheet (e.g., Patent Literature 2) are known as such a label manufacturing device as the above.

CITATION LIST

Patent Literatures

Patent Literature 1: JP-1995-35104B2
Patent Literature 2: JP-A-2002-1845

SUMMARY OF THE INVENTION

Problem(s) to be Solved by the Invention

However, the former of the above two devices requires changes in combinations of types of a base material sheet and an adhesive agent depending on a purpose and intended use because the device prints a web laminated beforehand with an adhesive agent layer on a base material sheet, forcing those in the printing industry offering this type of printing to own a stockpile of webs that matches the number of the combinations. Though the latter is capable of switching base material sheets and adhesive agents, clean-up of an adhesive agent feeding head and the like using solvent is necessary when switching, thus causing workers significant workloads. Another problem is that it takes quite an effort to remove adhesive agent attached on a worker's hands, clothing and peripheral equipment and the like.

An object of the invention is to provide a label manufacturing device and a label printer that allow free combinations of a base material sheet and an adhesive agent used in a label sheet and eliminate workloads in clean-up and removal by workers of adhesive agent when changing base material sheets and adhesive agents.

Means for Solving the Problem(s)

A label manufacturing device according to an aspect of the invention includes: a base material feeder that feeds a belt-shaped base material sheet; a printing unit that prints on a first surface of the base material sheet; a film feeder that feeds a belt-shaped adhesive film that has first and second surfaces both of which are adapted to be adhered, a first release liner being temporarily attached on the first surface of the adhesive film; and an attachment unit that attaches the second surface of the adhesive film onto a second surface of the base material sheet.

The printing unit preferably includes a plate cylinder and an impression cylinder to press the base material sheet onto the plate cylinder, and the impression cylinder serves concurrently as the attachment unit. In other words, the printing unit in the above arrangement does not require a dedicated device for pressure-bonding the base material sheet and the adhesive film because the adhesive film is attached onto the base material sheet while the printing is performed.

The attachment unit may be configured to attach the adhesive film onto the base material sheet after completion of the printing by the printing unit. In other words, in the above configuration, the printing unit and the attachment unit are independent of one another.

A second release liner may be temporarily attached on the second surface of the adhesive film. In this case, the label manufacturing device further includes a peeling unit that peels the second release liner.

The printing unit may be adapted to print on the second surface of the base material sheet.

A label printer according to another aspect of the invention includes: a plate cylinder that holds a plate; and an impression cylinder provided opposed to the plate cylinder, in which the belt-shaped base material sheet and the belt-shaped adhesive film having the first and second surfaces being adapted to be adhered while a first release liner is temporarily attached on the first surface of the adhesive film are sandwiched and transferred by the plate cylinder and the impression cylinder, so that a printing is performed on a first surface of the base material sheet while the second surface of the adhesive film is attached onto a second surface of the base material sheet.

Advantage(s) of the Invention

According to the invention, a base material sheet and adhesive agent used for a label sheet can be freely combined, and workloads in clean-up and removal by workers of adhesive agent and other operations when switching base material sheets and/or adhesive agent can be eliminated.

BRIEF DESCRIPTION OF DRAWING(S)

FIG. 1 schematically shows a configuration of a label manufacturing device according to an exemplary embodiment of the invention.

Figure 2:
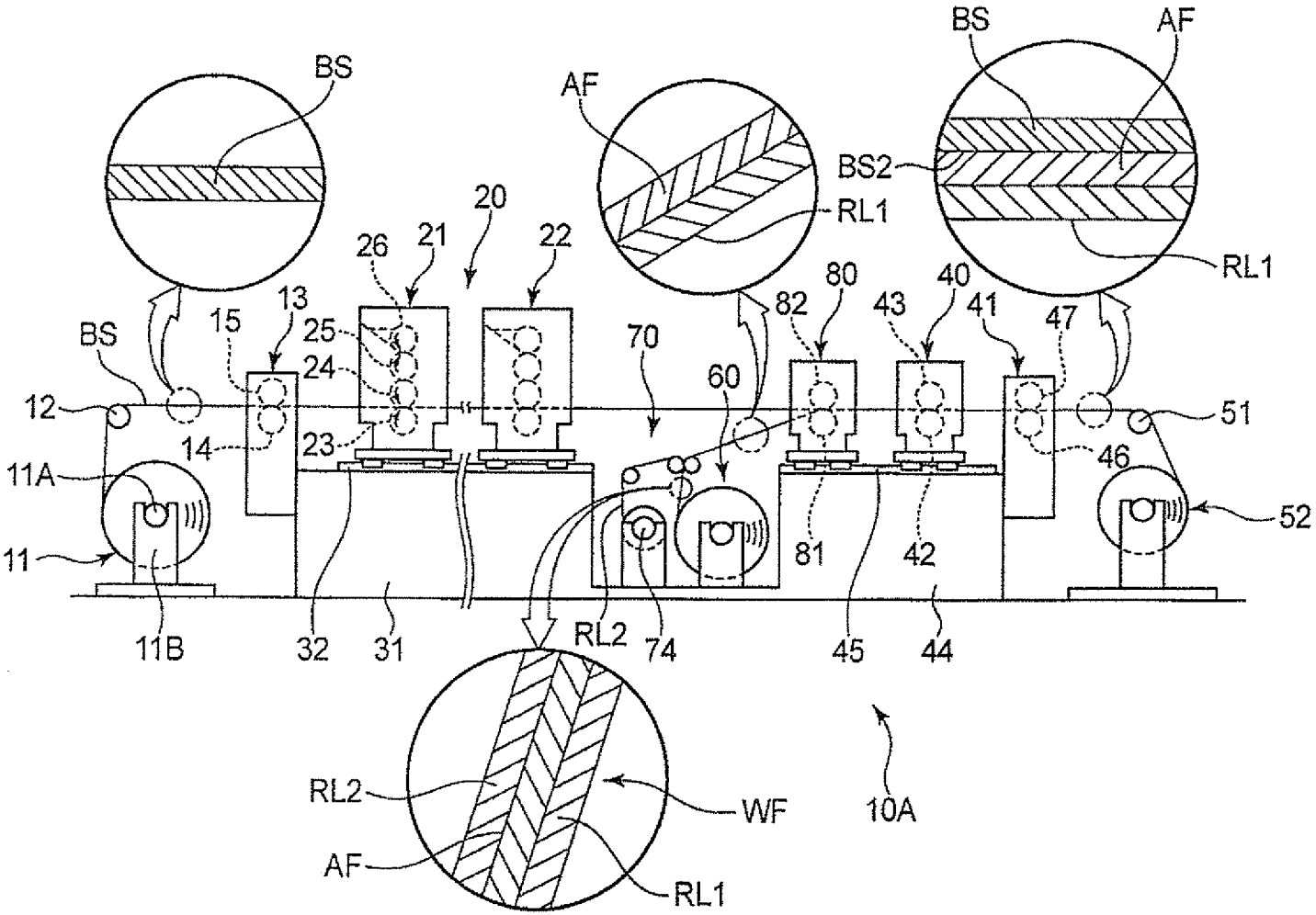

FIG. 2 schematically shows a configuration of a label manufacturing device according to another exemplary embodiment of the invention.

Figure 3:
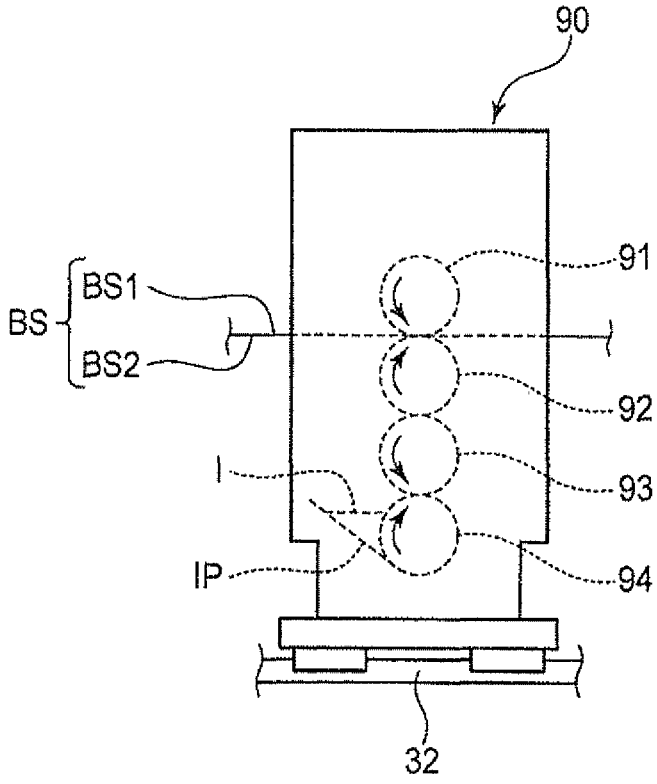

FIG. 3 is a schematic side view of a printing unit to print on a bottom surface of a base material sheet.

DESCRIPTION OF EMBODIMENT(S)

A label manufacturing device and label printer according to the invention will be described below by reference to exemplary embodiments.

FIG. 1 schematically shows a configuration of a label manufacturing device 10 according to an exemplary embodiment of the invention, which is provided with a label printer 20 (a printing unit).

In summary, the label manufacturing device 10 includes: a base material supplying unit 11 from which a belt-shaped base material sheet BS is pulled up; a guide roller 12 that guides the base material sheet BS toward a feeding drive unit 13; and the label printer 20 to which the base material sheet BS is supplied. On the other hand, a belt-shaped adhesive film AF that enables adhesion of both sides and is temporarily attached with a first release liner RL1 on an adhered attachment surface (a first surface) AF1 (an upper surface in an expanded view F3 of FIG. 1) is supplied to the label printer 20 via a peeling unit 70 (a peeling unit) from an adhesive film supplying unit 60 (a film feeder). The base material sheet BS has a front surface (a first surface) BS1 (an upper surface in an expanded view F1 of FIG. 1) and a back surface (a second surface) BS2 (a lower surface in the expanded view F1 of FIG. 1). In the label printer 20, printing is made on the front surface BS1, and a base material attachment surface (a second surface of the adhesive film AF) AF2 (a lower surface in the expanded view F3 of FIG. 1) is attached onto the back surface BS2 to provide a label sheet LS (see an expanded view F4 of FIG. 1) made up of the base material sheet BS, the adhesive film AF and the first release liner RL1. The label sheet LS is then conveyed to a cutter 40, where a cut line C is formed that extends from the first surface of the base material sheet BS into the first release liner RL1. Afterwards, the label sheet LS is transferred by a winding drive unit 41 and is guided toward a product winding unit 52 by a guide roller 51 to be wound up. Incidentally, the base material supplying unit 11, the feeding drive unit 13, the winding drive unit 41 and the product winding unit 52 constitute a base material feeder.

Details of a configuration of the label manufacturing device will be provided below.

The base material supplying unit 11 is provided with a support roller 11A to support the base material sheet BS that is wound in a roll, as well as a support bracket 11B to support the support roller 11A in a rotatable manner. The base material sheet BS may be constructed of, for instance, one or multiple layers of a belt-shaped sheet made of paper or resin.

The feeding drive unit 13 is installed between a guide roller 12 and the label printer 20. The feeding drive unit 13 is provided with a drive roller 14 that is positioned on a side of the back surface BS2 of the base material sheet BS and is connected to a motor (not shown), as well as a driven roller 15 that is positioned on a side of the front surface BS1 of the base material sheet BS and rotates in conjunction with the drive roller 14 via an interlocking member such as a timing belt (not shown).

The label printer 20 may include the number of printing units in accordance with usage. In normal color printing, four printing units 21 are arranged in order along a direction of transferring the base material sheet BS to print in four colors of black, cyan, magenta and yellow (two of the printing units 21 not shown in FIG. 1). The printing unit 21 includes: an impression cylinder 23 that is positioned on a side of the back surface BS2 of the base material sheet BS; a plate cylinder 24 that is positioned on a side of the front surface BS1 of the base material sheet BS; ink supply rollers 25 and 26 that are located on an upper side of the plate cylinder 24; and an ink pan IP that abuts the ink supply roller 26. The printing unit 21 is supported in a manner capable of displacement along the direction of transferring the base material sheet BS via a rail 32 and a slider 32A provided on a base 31. The impression cylinder 23 is connected to an output shaft of a motor (not shown) for rotation. The plate cylinder 24 and the ink supply rollers 25 and 26 rotate in conjunction with the impression cylinder 23 via the interlocking member such as a timing belt (not shown) The plate cylinder 24 is adapted to hold a plate on which content to be printed on the base material sheet BS is formed (not shown). Ink I that is stored in the ink pan IP is supplied to the plate via the ink supply rollers 25 and 26, so that the content is printed on the front surface BS1 of the base material sheet BS. The height position of the impression cylinder 23 can be adjusted in an up-down direction in FIG. 1 by a position adjuster (not shown). The impression cylinder 23 is thereby appropriately spaced away from the plate cylinder 24 depending on a thickness of the base material sheet BS and the like, so that the impression cylinder 23 is pressed on the base material sheet BS with adequate force. By rotating the impression cylinder 23 and the plate cylinder 24 in conjunction with the base material feeder, the base material sheet BS that is transferred between the two cylinders is printed. Since other printing units 21 have the same configuration, description of the other printing units 21 is omitted.

The adhesive film supplying unit 60 is arranged between the label printer 20 and the cutter 40. The adhesive film supplying unit 60 includes: a support roller 60A that supports the adhesive film AF wound up in a roll; and a support bracket 60B that supports the support roller 60A in a rotatable manner. Incidentally, the adhesive film AF is supported by the support roller 60A and is a form of a raw film WF having a triple-layered structure in which the first release liner RL1 is temporarily attached to the adhered attachment surface AF1 and a second release liner RL2 is temporarily attached to the base material attachment surface AF2, as shown in an expanded view F2 in FIG. 1.

A peeling unit 70 includes: a drive roller 71 that rotates in conjunction with an output shaft of a motor (not shown); a peeling roller 72 that sandwiches the raw film WF with the drive roller 71 and peels the second release liner RL2; a winding roller 74 that rotates in conjunction with an output shaft of a motor (not shown) and winds up the second release liner RL2 that is partially wound around a guide roller 73; and a support bracket 75 that supports the winding roller 74 in a rotatable manner. Thus, the second release liner RL2 is peeled by the peeling roller 72 from the raw film WF fed from the adhesive film supplying unit 60. The belt-shaped adhesive film AF that is temporarily attached with the first release liner RL1 is then supplied to the label printer 20.

The adhesive film AF temporarily attached with the first release liner RL1 is partially wound on the impression cylinder 23 of the printing unit 21 on a right side (downstream-most side) of FIG. 1, where the base material attachment surface AF2 of the adhesive film AF is attached to the back surface BS2 of the base material sheet BS, so that the label sheet LS having a triple-layered structure in which the printed base material sheet BS, the adhesive film AF and the first release liner RL1 are laminated in this order from above is formed as shown in the expanded view F4 of FIG. 1. Incidentally, the printing unit 21 in which the adhesive film AF and the first release liner RL1 are partially wound on the impression cylinder 23 may not be the most downstream printing unit 21, but may be other one of printing unit 21 (e.g. the most upstream printing unit 21).

The cutter 40 includes: a platen roller 42 that is positioned on a side of the first release liner RL1 of the label sheet LS and is connected to a motor (not shown); and a die cutting roller 43 that is positioned on a side of the base material sheet BS of the label sheet LS and rotates in conjunction with the platen roller 42 via an interlocking member such as a timing belt (not shown). The cutter 40 is supported in a fashion that enables displacement along a direction of transferring the label sheet LS via a rail 45 and a slider 45A thereof provided on a base 44. The base material sheet BS and the adhesive film AF are provided with the cut line C that is made by the die cutting roller 43 corresponding to a predetermined label shape, so that the base material sheet BS and the adhesive film AF can be peeled off from the first release liner RL1.

The winding drive unit 41 includes: a drive roller 46 that is positioned on a side of the first release liner RL1 of the label sheet LS and is connected to a motor (not shown); and a driven roller 47 that is positioned on a side of the base material sheet BS of the label sheet LS and rotates in conjunction with the drive roller 46 via an interlocking member such as a timing belt (not shown).

The product winding unit 52 includes: a winding roller 52A that rotates in conjunction with an output shaft of a motor (not shown) and winds up the label sheet LS guided by a guide roller 51; and a support bracket 52B that rotatably supports the winding roller 52A.

As discussed above, in the label manufacturing device 10 in the exemplary embodiment of the invention, the adhesive film AF can be attached to the base material sheet BS by using the raw film WF that includes the first and second release liners RL1 and RL2 temporarily attached onto both surfaces of the sheet-shaped adhesive film AF and peeling the second release liner RL2 from the adhesive film AF. Accordingly, since the base material sheet BS and the adhesive film AF can be combined simultaneously with printing on the base material sheet BS, those in the printing industry are not required to keep the number of label sheets LS in stock that corresponds to the number of combinations made depending on a purpose and usage. When switching adhesive agents provided on a label, all required work is to select the raw film WF that is provided with the adhesive film AF made of a desired adhesive agent. Further, in changing adhesive agents, all required work is to place the predetermined raw film WF in the adhesive film supplying unit 60, thus removing burdens of clean-up, removal of adhesive agent and the like conventionally performed by workers.

In the present exemplary embodiment, the label printer 20 is configured to sandwich the base material sheet BS, the adhesive film AF and the first release liner RL1 by the impression cylinder 23 and the plate cylinder 24 and print on the base material sheet BS while attaching the adhesive film AF to the base material sheet BS by a biasing force generated by the sandwiching. In other words, the impression cylinder 23 of the label printer 20 serves concurrently as an attachment unit, thus eliminating a need to provide a dedicated attachment unit for pressure bonding the adhesive film AF and the base material sheet BS.

FIG. 2 schematically shows a configuration of a label manufacturing device 10A according to another exemplary embodiment of the invention. The label manufacturing device 10A differs from the label manufacturing device 10 shown in FIG. 1 in that the label printer 20 of the label manufacturing device 10A only prints on the base material sheet BS and does not function concurrently as an attachment unit to attach the adhesive film AF to the base material sheet BS and that a pressing machine 80 to attach the adhesive film AF temporarily attached with the first release liner RL1 to the base material sheet BS is provided. Other configurations are the same as in the exemplary embodiment in FIG. 1.

The pressing machine 80 includes: a drive roller 81 that is connected to a motor (not shown); and a driven roller 82 that rotates in conjunction with the drive roller 81 via an interlocking member such as a timing belt (not shown). The pressing machine 80 is supported in a manner displaceable along the transfer direction of the label sheet LS via the rail 45 provided on the base 44. A distance between the drive roller 81 and the driven roller 82 can be adjusted by a position adjuster (not shown), so that a pressure-bonding force suitable for a thickness of the base material sheet BS, the adhesive film AF and the like can be obtained.

As discussed above, in the label manufacturing device 10A, an attachment unit to attach the adhesive film AF to the base material sheet BS attaches the adhesive film AF to the base material sheet BS after completion of printing by the label printer 20. Thus, the label manufacturing device 10A provides the same advantage as the label manufacturing device 10. Moreover, since the label printer 20 of the label manufacturing device 10A does not attach the adhesive film AF to the base material sheet BS, it has more leeway in arrangements of each printing unit (e.g. freedom is given in arrangements of a printing unit 90 (described below) for printing bottom surfaces and the like).

In the above two exemplary embodiments, the label manufacturing device is configured in a way that printing is conducted on the front surface BS1 of the base material sheet BS. However, a printing unit for printing on the back surface BS2 of the base material sheet BS may be further provided. FIG. 3 schematically shows a configuration of the printing unit 90 for printing on back surfaces. The printing unit 90 includes: an impression cylinder 91 that is positioned on a side of the front surface BS1 of the base material sheet BS; a plate cylinder 92 that is positioned on a side of the back surface BS2 of the base material sheet BS; ink supply rollers 93 and 94 that are located under the plate cylinder 92; and an ink pan IP that abuts the ink supply roller 94. The printing unit 90 is supported in a manner displaceable along the transfer direction of the base material sheet BS via the rail 32 and the slider 32A thereof provided on the base 31. The impression cylinder 91 rotates by being connected to an output shaft of a motor (not shown). The plate cylinder 92 and the ink supply rollers 93 and 94 rotate in conjunction with the impression cylinder 91 via an interlocking member such as a timing belt (not shown) The plate cylinder 92 is adapted to hold a plate on which content to be printed on the base material sheet BS is formed (not shown). Ink I that is stored in the ink pan IP is supplied to the plate via the ink supply rollers 93 and 94, so that the content is printed on the back surface BS2 of the base material sheet BS. The printing unit 90 for printing on bottom surfaces can be arranged at a given position in the label printer 20. According to the configuration in FIG. 1, the printing unit 90 is provided upstream on a transferring path of the base material sheet BS, compared to the printing unit 21 having the impression cylinder 23 on which the adhesive film AF and the first release liner RL1 are wound.

Incidentally, the adhesive film AF is not limited to the configurations described in the above exemplary embodiments. For instance, the adhesive film AF may be provided by a sheet-shaped core applied with an adhesive agent on both surfaces thereof. When the adhesive film has a core as described above, adhesive agent layers having different natures on both sides of the core can be provided, so that gaps in bonding strength between the front and back surfaces of the adhesive film can be provided and the adhesive film can be used for a label sheet that has a release liner attached only on one surface thereof.

The invention claimed is:

1. A label manufacturing device comprising:

a base material feeder that feeds a belt-shaped base material sheet;

a printing unit that prints on a first surface of the base material sheet;

a film feeder that feeds a belt-shaped adhesive film that has first and second surfaces both of which are adapted to be adhered, a first release liner being temporarily attached on the first surface of the adhesive film; and an attachment unit that attaches the second surface of the adhesive film onto a second surface of the base material sheet, wherein the printing unit comprises a plate cylinder and an impression cylinder to press the base material sheet onto the plate cylinder, the impression cylinder serving concurrently as the attachment unit and the printing being performed while the adhesive film is attached onto the base material sheet.

2. The label manufacturing device according to claim 1, wherein the attachment unit attaches the adhesive film onto the base material sheet after completion of the printing by the printing unit.

3. The label manufacturing device according to claim 1, wherein a second release liner is temporarily attached on the second surface of the adhesive film and the label manufacturing device further comprises a peeling unit that peels the second release liner.

4. The label manufacturing device according to claim 1, wherein the printing unit is adapted to print on the second surface of the base material sheet.

5. A label printer comprising:

a plate cylinder that holds a plate; and an impression cylinder provided opposed to the plate cylinder, wherein a belt-shaped base material sheet and a belt-shaped adhesive film are sandwiched and transferred by the plate cylinder and the impression cylinder, the adhesive film having first and second surfaces being adapted to be adhered, a first release liner being temporarily attached on the first surface of the adhesive film, so that a printing is performed on a first surface of the base material sheet while the second surface of the adhesive film is attached onto a second surface of the base material sheet.

* * * * *